United States Patent [19]

Cress

[11] Patent Number: 5,060,344

[45] Date of Patent: Oct. 29, 1991

[54] SELF-LATCHING KNIFE HINGE

[75] Inventor: David R. Cress, Janesville, Wis.

[73] Assignee: Amerock Corporation, Rockford, Ill.

[21] Appl. No.: 533,088

[22] Filed: Jun. 4, 1990

[51] Int. Cl.[5] ..... E05D 11/10

[52] U.S. Cl. ..... 16/332; 16/335

[58] Field of Search ..... 16/332, 335, 336

[56] References Cited

U.S. PATENT DOCUMENTS

| | | | |
|---|---|---|---|
| 539,741 | 5/1895 | Ingram | 16/335 |
| 2,707,064 | 4/1955 | Castello | 217/60 |
| 3,203,031 | 8/1965 | Youngdale et al. | 16/145 |
| 3,432,879 | 3/1969 | Gorton et al. | 16/336 |
| 3,623,185 | 11/1971 | Cartwright et al. | 16/335 |
| 3,860,995 | 1/1975 | Lautenschlager, Jr. et al. | 16/332 |

FOREIGN PATENT DOCUMENTS

| | | | |
|---|---|---|---|
| 2828052 | 1/1980 | Fed. Rep. of Germany | 16/336 |
| 967276 | 8/1964 | United Kingdom . | |

*Primary Examiner*—Robert L. Spruill
*Assistant Examiner*—Carmine Cuda
*Attorney, Agent, or Firm*—Leydig, Voit & Mayer, Ltd.

[57] ABSTRACT

The hinge includes pivotally interconnected door and frame wings for mounting a cabinet door for swinging between open and closed positions on a cabinet frame. A substantially J-shaped latching finger is formed integrally with the door wing and coacts with a cam on the frame wing to releasably latch the door as the door is swung to its closed position.

6 Claims, 2 Drawing Sheets

SELF-LATCHING KNIFE HINGE

BACKGROUND OF THE INVENTION

This invention relates to a hinge for mounting a door such as a cabinet door for swinging between open and closed positions on a frame such as a cabinet. The invention more specifically relates to a so-called knife hinge having door and frame wings with blade-like portions which are received in a slot in the door. With wings of this type, the hinge is fully concealed from the front of the cabinet, and only a small portion of the hinge is visible from the hinged edge of the door when the door is in its closed position.

A knife hinge of this general type is disclosed in Youngdale et al U.S. Pat. No. 3,203,031. That hinge is a self-latching hinge in that it includes a mechanism for automatically latching the door as the door reaches its closed position and for thereafter releasably holding the door in the closed position. The Youngdale et al hinge, however, is relatively expensive in that the self-latching mechanism requires multiple components. In addition to the cost of the components themselves, there are significant costs involved in assembling the components with one another and with the remainder of the hinge.

SUMMARY OF THE INVENTION

The general aim of the present invention is to provide a new and improved self-latching knife hinge which, when compared with prior hinges of the same general type, is significantly easier to manufacture and is quieter in operation.

A more detailed object of the invention is to achieve the foregoing by providing a hinge in which the latching mechanism of the door wing is defined by a single component which is formed integrally with the door wing so as to eliminate multiple components and the need for assembling the same.

In still a more specific sense, the invention resides in a knife hinge in which a resiliently yieldable latching finger is formed integrally with the door wing and coacts uniquely with a cam on the frame wing to releasably hold the door in its closed position.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3, 4:
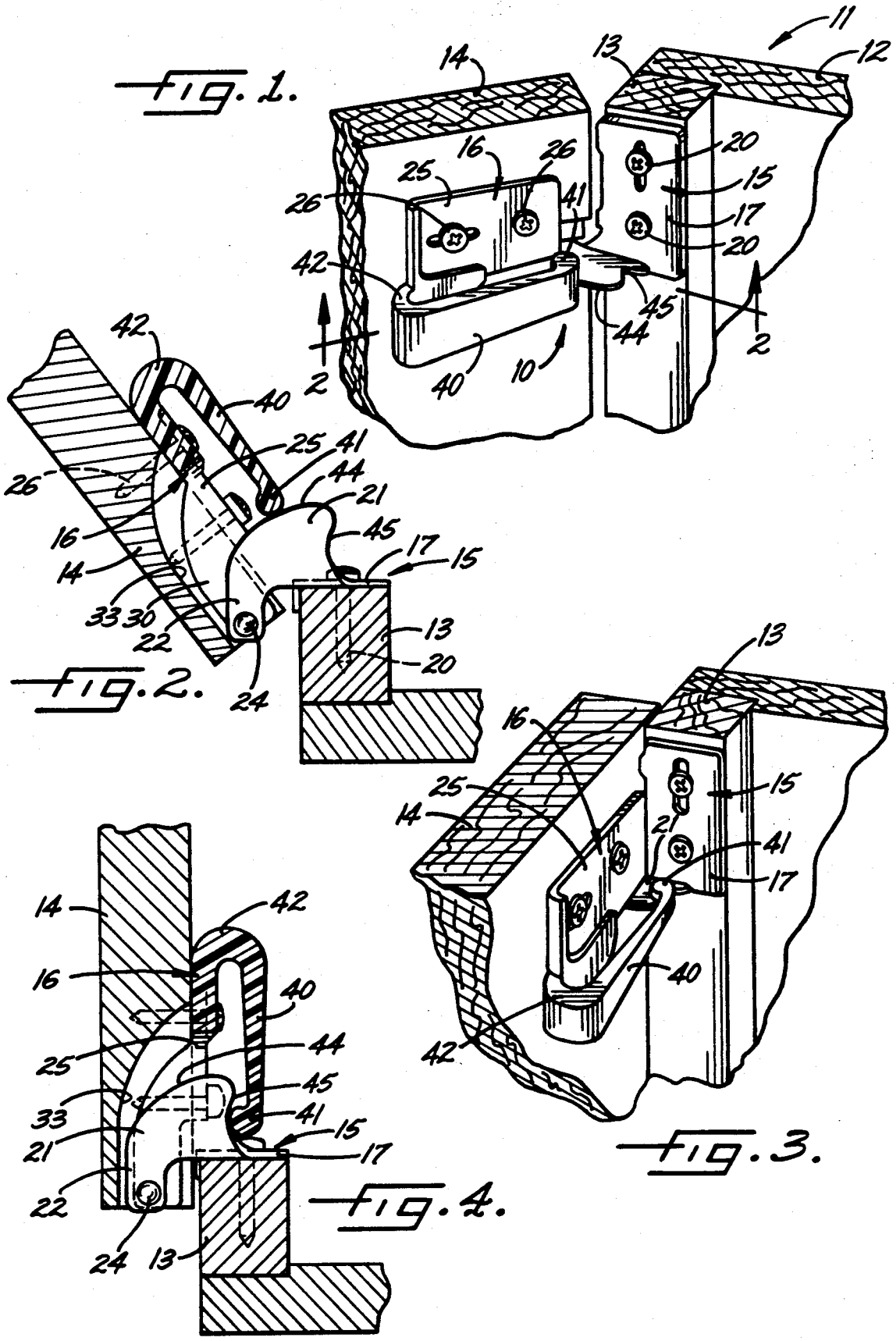
FIG. 1 is a fragmentary perspective view of a typical cabinet equipped with a new and improved hinge incorporating the unique features of the present invention, the door of the cabinet being shown in a partially open position.
FIG. 2 is a fragmentary cross-section taken substantially along the line 2—2 of FIG. 1.
FIG. 3 is a view similar to FIG. 1 but shows the door in a fully closed position.
FIG. 4 is a bottom plan view of the hinge shown in FIG. 3, certain parts of the hinge and the cabinet being broken away and shown in section.

For purposes of illustration, the knife hinge 10 of the present invention has been shown in the drawings in conjunction with a cabinet such as a kitchen cabinet 11 having a base 12 with a front frame member 13 which defines part of the front opening of the cabinet. The hinge mounts an upright door 14 on the frame member for swinging between open and closed positions about a vertical axis. An identical hinge (not shown) is spaced vertically from the hinge 10 and also is connected between the door and the frame member.

Figure 7:
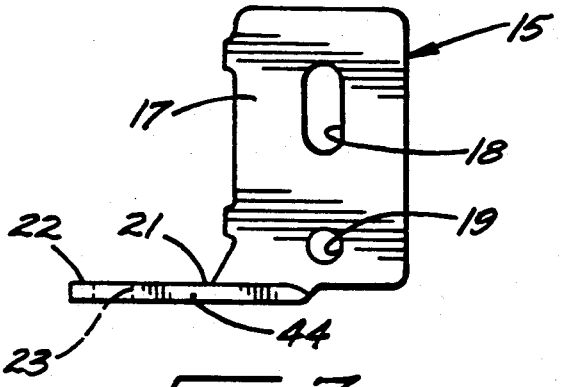
FIG. 7 is an elevational view of the frame wing of the hinge as seen from the inboard edge surface of the cabinet frame.
Figure 8:
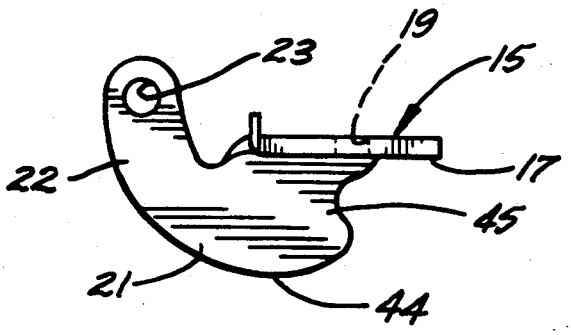
FIG. 8 is a bottom plan view of the frame wing.

The hinge 10 includes frame and door wings 15 and 16 which are attachable to the frame 13 and the door 14, respectively. The frame wing 15 is stamped and formed from metal and basically is of conventional construction. It includes an upright mounting plate 17 adapted to lie face-to-face with the inboard side of the frame member 13 and formed with a slot 18 (FIG. 7) and a hole 19 for receiving screws 20 (FIG. 1) which fasten the frame wing 15 to the frame member. Formed integrally with and projecting horizontally from the lower margin of the plate 17 is a blade-like lug or tab which defines a cam 21. An ear 22 (FIGS. 2 and 8) is integral with one end of the cam 21 and is formed with a vertically extending hole 23 (FIG. 8) for receiving a pivot member such as a rivet 24 (FIG. 4). The rivet pivotally interconnects the frame wing 15 with the door wing 16.

Figure 5:
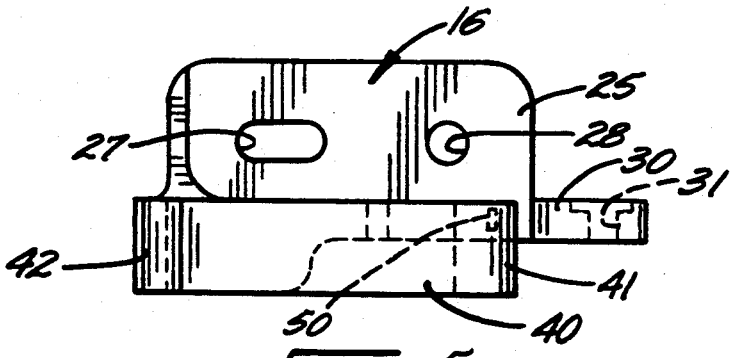
FIG. 5 is an elevational view of the door wing of the hinge as seen from the rear face of the cabinet door.

As shown most clearly in FIGS. 1 and 5, the door wing 16 also includes an upright mounting plate 25 which lies face-to-face with the rear side of the door 14. Screws 26 (FIG. 1) extend through a slot 27 (FIG. 5) and a hole 28 in the plate 25 to secure the door wing 16 to the door 14.

Formed integrally with and projecting forwardly from the lower margin of the mounting plate 25 of the door wing 16 is an ear 30 (FIG. 5) which is disposed in a horizontal plane. A hole 31 is formed in the free end portion of the ear and, when the hinge 10 is assembled, the hole 31 is located in vertical alinement with the hole 23 in the frame wing 15 and receives the rivet 24. Thus, the rivet pivotally interconnects the two wings 15 and 16.

As shown in FIGS. 2 and 4, a slot 33 is formed in the rear face of the door 14 and opens out of the hinged edge thereof. The ears 22 and 30 of the wings 15 and 16 are located in the slot as is the rivet 24. When the door is fully closed as shown in FIG. 4, the entire hinge 10 is concealed from the front of the cabinet 11. Only a small portion of the hinge is visible from the hinged edge of the door. As the door is opened and closed, the ear 30 scissors back and forth across the ear 22 in the manner of a conventional knife hinge.

In knife hinges, it is known to provide a self-latching mechanism for holding the door 14 releasably in its closed position. According to the present invention, the door wing 16 is constructed with an integral self-latching device 40 which reduces the cost of manufacturing a self-latching knife hinge and also reduces the noise produced as the device latches and unlatches.

Figure 6:
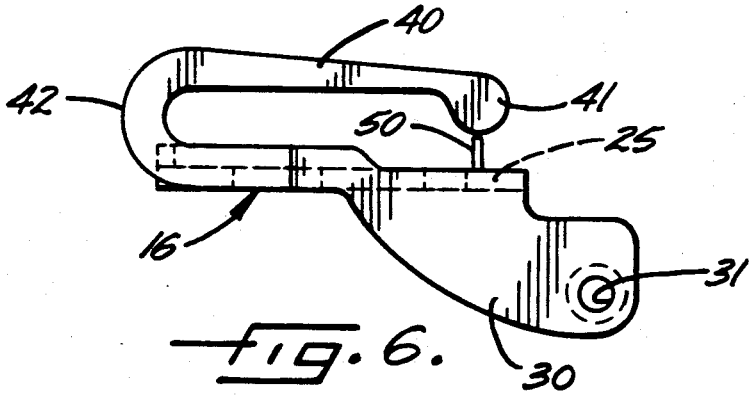
FIG. 6 is a bottom plan view of the door wing.

More specifically, the door wing 16 is made of a single piece of resiliently yieldable material, the door wing preferably being injection molded from plastic such as Acetal. In carrying out the invention, the latching device 40 takes the form of a substantially J-shaped finger. Along most of its length, the finger 40 is spaced rearwardly from and is disposed in opposing relation with the mounting plate 25 of the door wing 16. The end of the finger nearest the rivet 24 is a free end and is formed by a rounded nose 41 which extends forwardly from the finger when the door 14 is closed. The opposite end portion of the finger 40 is integrally hinged to the mounting plate 25 by a generally C-shaped section 42 (FIG. 6) of plastic. As a result of the hinge section 42, the finger 40 is supported cantilever fashion on the plate 25 to flex toward and away from the rear face of the door 14.

As shown in FIG. 2, the nose 41 of the finger 40 engages an edge 44 of the cam 21 when the door 14 is partially open. The edge 44 is irregularly shaped and defines a cam surface. When the door is opened beyond the position shown in FIG. 2, the nose 41 of the finger 40 pulls away from the cam surface 44 but, as the door is reclosed, the nose re-engages the cam surface. With further closing of the door, the nose rides along the cam surface and, due to the shape of the cam surface, the finger 40 is flexed rearwardly and resiliently away from the door as permitted by the C-shaped hinge section 42. As the door reaches its fully closed position, the nose 41 encounters a pocket 45 at the end of the cam surface 44. By virtue of the resiliency of the flexed finger 40, the nose 41 snaps into the pocket 45 upon final closing of the door and thereafter coacts with the pocket to releasably latch the door closed. When a substantial opening force is applied to the door 14, the finger 40 flexes rearwardly to cause the nose 41 to pop out of the pocket 45 and permit opening of the door.

When the door wing 16 cools after being molded, shrinkage of the plastic tends to cause the free end portion of the latching finger 40 to warp toward the mounting plate 25. To prevent excessive warpage, a short horizontally extending post 50 (FIGS. 5 and 6) is molded integrally with the mounting plate and extends horizontally therefrom into engagement with the forward side of the nose 41. Accordingly, the post 50 maintains a minimum spacing between the nose and the mounting plate as the door wing cools and prevents the finger from warping in toward the mounting plate. The post is located well above the elevation of the cam 21 and thus does not interfere with the latching and unlatching action. For clarity of illustration, the post has been omitted from FIGS. 1 to 4.

From the foregoing, it will be apparent that the present invention brings to the art a new and improved knife hinge 10 in which a latching finger 40 is formed integrally with a door wing 16 so as to eliminate the cost of multiple latching components. While the door wing and the latching finger have been specifically disclosed as being made of plastic, it will be appreciated that a one-piece metal component could be produced. Plastic is preferred, however, from the standpoint of lower cost, smoother and quieter operation, better durability and more color selections.

I claim:

1. A hinge for mounting a door for swinging between open and closed positions on a frame, said hinge comprising door and frame wings mountable on the door and the frame, respectively, a pivot interconnecting said wings to permit swinging of said door between said open and closed positions, a latching finger disposed in spaced opposing relation with said door wing and having first and second end portions, said finger and said door wing being made of a single piece of resiliently yieldable plastic, the first end portion of said finger being integral with said door wing and being resiliently hinged thereto so as to permit the second end portion of said finger to swing cantilever fashion toward and away from said door wing, a post molded integrally with and extending from said door wing and engaging the second end portion of said finger to limit movement of said finger toward said door wing, the second end portion of said finger extending toward said frame wing and having a free end, said frame wing including a cam having a cam surface engageable with the free end of said latching finger to force the second portion of said finger to swing away from said door wing as the door is swung toward said closed position, and a pocket in said cam adjacent the cam surface thereof, the free end portion of said finger snapping resiliently toward said door wing and into said pocket as the door reaches said closed position and thereafter coacting with the pocket to latch the door releasably in its closed position.

2. A hinge as defined in claim 1 in which said finger is generally J-shaped.

3. A hinge as defined in claim 2 in which said first end portion of said finger is generally C-shaped.

4. A knife hinge for mounting an upright door for swinging between open and closed positions on a frame, said hinge comprising a door plate disposed in an upright plane and adapted to be secured in face-to-face relation with the door, a frame plate disposed in an upright plane and adapted to be secured in face-to-face relation with the frame, said door plate having an integral ear disposed in a generally horizontal plane and adapted to be received in a slot in the door, said frame plate including an integral cam disposed in a generally horizontal plane and having an end portion adapted to be received in said slot, a pivot member pivotally interconnecting said ear and said end portion of said cam and supporting said door to swing about an upright axis between said open and closed positions, a substantially J-shaped latching finger disposed in spaced opposing relation with said door plate and having first and second end portions, the first end portion of said finger being integral with said door plate and being resiliently hinged thereto so as to permit the second end portion of said finger to swing cantilever fashion toward and away from said door plate, the second end portion of said finger extending toward said frame plate and having a free end, said cam having a cam surface engageable with the free end of said latching finger to force the second portion of said finger to swing away from said door plate as the door is swung toward said closed position, and a pocket in said cam adjacent the cam surface thereof, the free end portion of said finger snapping resiliently toward said door plate and into said pocket as the door reaches said closed position and thereafter coacting with the pocket to hold the door releasably in its closed position.

5. A knife hinge as defined in claim 4 in which said door plate, said ear and said finger are made of a single piece of resiliently yieldable plastic.

6. A knife hinge as defined in claim 5 in which said first end portion of said finger is generally C-shaped.

* * * * *